US010864619B2

(12) United States Patent
Sergyeyenko et al.

(10) Patent No.: US 10,864,619 B2
(45) **Date of Patent: *Dec. 15, 2020**

(54) ILLUMINATED POWER TOOL

(71) Applicant: BLACK & DECKER INC., New Britain, CT (US)

(72) Inventors: Oleksiy P. Sergyeyenko, Baldwin, MD (US); Keith D. Flaharty, Wrightsville, PA (US)

(73) Assignee: Black & Decker Inc., New Britain, CT (US)

( * ) Notice: Subject to any disclaimer, the term of this patent is extended or adjusted under 35 U.S.C. 154(b) by 134 days.

This patent is subject to a terminal disclaimer.

(21) Appl. No.: 16/175,946

(22) Filed: Oct. 31, 2018

(65) Prior Publication Data

US 2019/0061124 A1 Feb. 28, 2019

Related U.S. Application Data

(63) Continuation of application No. 14/967,916, filed on Dec. 14, 2015, now Pat. No. 10,173,307, which is a continuation of application No. 13/448,459, filed on Apr. 17, 2012, now Pat. No. 9,242,355.

(51) Int. Cl.

| | |
|---|---|
| ***B25B 21/00*** | (2006.01) |
| ***B25B 23/18*** | (2006.01) |
| ***B25F 5/00*** | (2006.01) |
| ***B25B 21/02*** | (2006.01) |

(52) U.S. Cl.

CPC ..... *B25B 23/18* (2013.01); *B25B 21/00* (2013.01); *B25B 21/02* (2013.01); *B25F 5/00* (2013.01)

(58) Field of Classification Search

CPC ..... B25B 21/00; B25B 21/02; B25B 23/14; B25B 23/18; B25F 5/00; B25F 5/02; B25F 5/021; B23D 59/002; B23D 59/003

USPC ..... 173/1, 20, 104, 132, 176, 178, 216, 217, 173/171; 362/109, 119, 120, 184, 578; 310/47, 50, 73; 408/16; 33/286, 642

See application file for complete search history.

(56) References Cited

U.S. PATENT DOCUMENTS 4,078,869 A * 3/1978 Honeycutt ..... B25F 5/021 33/286
4,240,748 A * 12/1980 Blanc ..... G06K 7/10881 235/462.45
5,473,519 A * 12/1995 McCallops ..... B25B 23/00 362/120
6,079,846 A * 6/2000 Huang ..... B25B 23/18 362/109

(Continued)

*Primary Examiner* — Scott A Smith
(74) *Attorney, Agent, or Firm* — Stephen R. Valancius

(57) ABSTRACT

A power tool with a chuck and a tool body having a housing, a motor received in the housing, a light array mounted to the housing, and an output spindle extending through the light array and which is rotationally driven by the motor. The chuck has a chuck body, a plurality of jaws, and an outer sleeve. A rear end of the chuck body is rotatably mounted on the output spindle. The chuck body has a plurality of jaw apertures and a plurality of light holes. The jaw apertures and the light holes extend through a front surface of the chuck body. Each of the jaws is received in a corresponding one of the jaw apertures. The outer sleeve is disposed about the jaws and the chuck body. Light emanating from the light array is transmitted through the light holes to illuminate a zone in front of the chuck body.

20 Claims, 3 Drawing Sheets

(56) References Cited

U.S. PATENT DOCUMENTS

| | | | | |
|---|---|---|---|---|
| 6,663,260 | B1 * | 12/2003 | Tieszen | G01N 21/8806 362/249.02 |
| 6,937,336 | B2 * | 8/2005 | Garcia | B23B 49/00 33/286 |
| 7,080,964 | B2 * | 7/2006 | Riley | B23B 31/1253 279/142 |
| 7,540,334 | B2 * | 6/2009 | Gass | B23B 31/123 173/171 |
| 8,496,366 | B2 * | 7/2013 | Leong | B25B 23/18 362/577 |
| 9,028,088 | B2 * | 5/2015 | Vanko | F21V 33/0084 362/119 |
| 9,242,355 | B2 * | 1/2016 | Sergyeyenko | B25B 21/00 |
| 9,328,915 | B2 * | 5/2016 | Vanko | B25F 5/021 |
| 10,173,307 | B2 * | 1/2019 | Sergyeyenko | B25B 21/00 |
| 2005/0047878 | A1 * | 3/2005 | Riley | B23Q 17/2404 408/16 |
| 2011/0188232 | A1 * | 8/2011 | Friedman | B25B 23/141 362/119 |
| 2011/0248650 | A1 * | 10/2011 | Sterling | B25F 5/00 315/307 |

* cited by examiner

ILLUMINATED POWER TOOL

CROSS-REFERENCE TO RELATED APPLICATION

This application is a continuation of U.S. application Ser. No. 14/967,916 filed Dec. 14, 2015, now U.S. Pat. No. 10,173,307, which is a continuation of U.S. application Ser. No. 13/448,459 filed Apr. 17, 2012, now U.S. Pat. No. 9,242,355, entitled ILLUMINATED POWER TOOL, which are hereby incorporated by reference in their entirety.

FIELD

The present disclosure relates to an illuminated power tool.

BACKGROUND OF THE INVENTION

This section provides background information related to the present disclosure which is not necessarily prior art.

Power tools are often used in a variety of conditions ranging from well-lit indoor work spaces to outside construction sites or other areas that are not always well-lit. Accordingly, it is desirable to provide a method or apparatus that permits a power tool to have a lighting feature that will illuminate the workpiece that is being machined or worked on by the power tool. Such a lighting feature will assist a user to be able to adequately see the workpiece or work area that is being worked on or machined by the power tool even in substandard light conditions.

SUMMARY

This section provides a general summary of the disclosure, and is not a comprehensive disclosure of its full scope or all of its features.

In one form, the present teachings provide a power tool that includes a tool body and a chuck. The tool body has a housing, a motor received in the housing, a light array mounted to the housing, and an output spindle extending through the light array and which is rotationally driven by the motor. The chuck has a chuck body, a plurality of jaws, and an outer sleeve. A rear end of the chuck body is fixedly mounted on the output spindle for common rotation with the output spindle about a rotational axis of the chuck. The chuck body has a plurality of jaw apertures and a plurality of light holes. The jaw apertures and the light holes extend through a front surface of the chuck body. Each of the jaws is received in a corresponding one of the jaw apertures. The outer sleeve is disposed about the jaws and the chuck body. Light emanating from the light array is transmitted through the light holes to illuminate a zone located in front of the chuck body.

In another form, the present teachings provide a power tool that includes a tool body, a chuck and an illuminating means. The tool body has an output spindle and a motor for driving the output spindle. The chuck is coupled to the output spindle for rotation therewith. The illuminating means is configured to illuminate a zone in front of the chuck.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
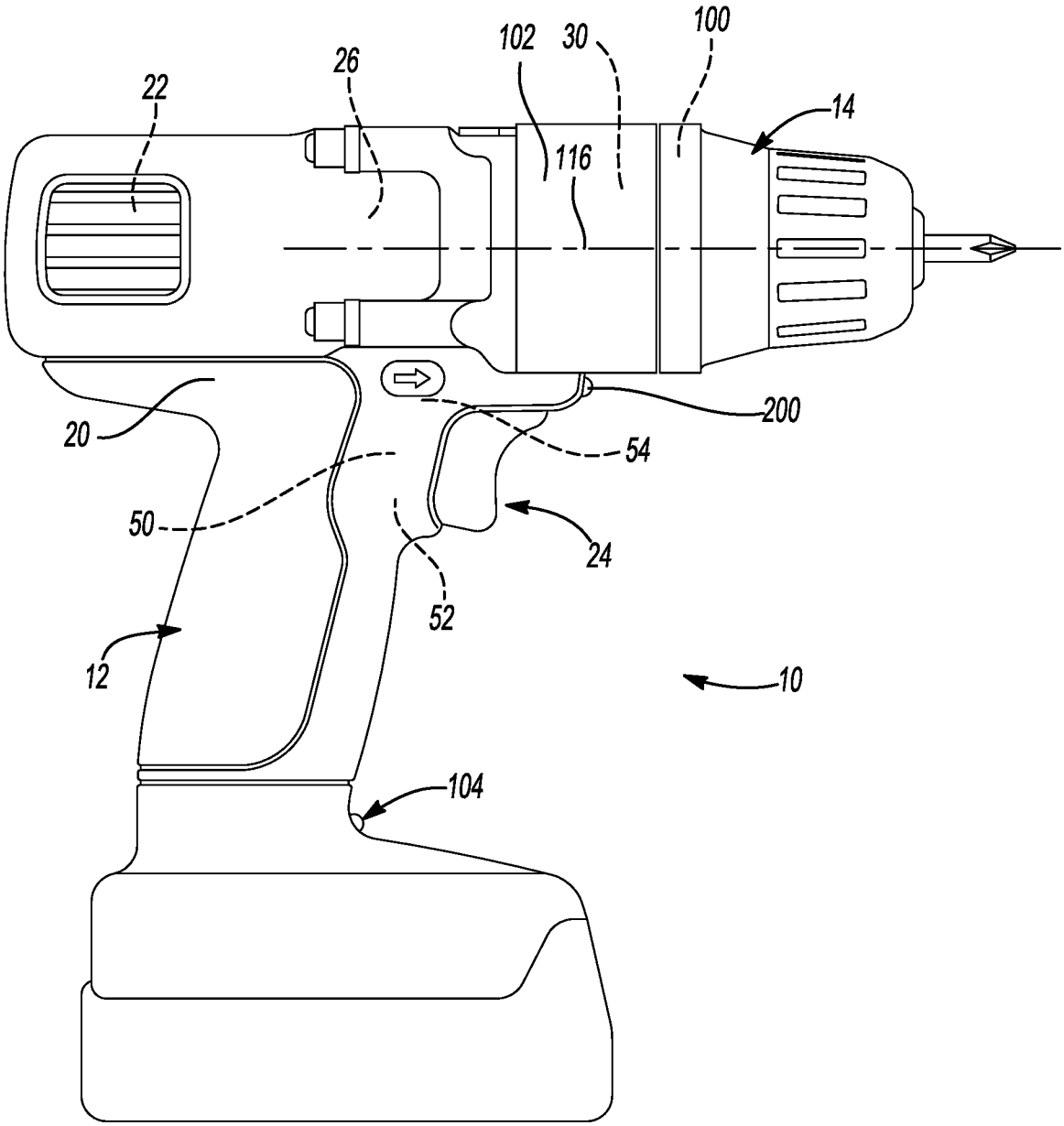
FIG. 1 is a side elevation view of an exemplary power tool constructed in accordance with the teachings of the present disclosure.

With reference to FIG. 1 of the drawings, an exemplary power tool constructed in accordance with the teachings of the present disclosure is generally indicated by reference numeral 10. The power tool 10 can include a tool body 12 and a chuck 14. The tool body 12 can be any type of tool having a rotary output that is suited to drive the chuck 14, such as a hammer/drill driver, a rotary impact/driver or a hammer/rotary impact/driver. In the particular example provided, the tool body 12 is a drill/driver. Except as described herein, the tool body 12 can be configured as a conventional drill driver similar to the drill/drivers disclosed in U.S. Pat. No. 6,431,289 and U.S. Patent Application Publication No. 2010/0163261, the disclosures of which are incorporated by reference as if fully set forth in detail herein.

Figure 2:
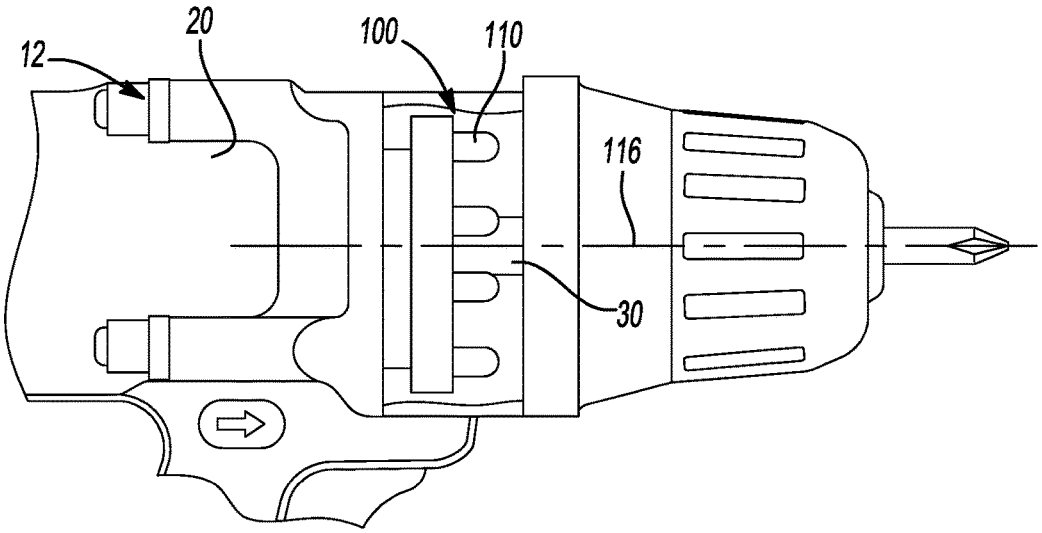
FIG. 2 is an enlarged view of a portion of the power tool of FIG. 1 with a shroud removed to better illustrate a light array.

With reference to FIGS. 1 and 2, the tool body 12 can comprise a housing 20, a motor 22, a trigger assembly 24, a transmission 26, and an output spindle 30. As those of skill in the art will appreciate, the housing 20 can house the motor 22, the trigger assembly 24 and the transmission 26. The motor 24 can be any type of electric motor, such as a brushed DC electric motor. The trigger assembly 24 can couple the motor 22 to a source of electrical power, such as a battery pack (not shown). The trigger assembly 24 can comprise a trigger controller 50, a trigger switch 52 and a trigger direction switch 54. The trigger controller 50 can conventionally direct power from the source of electrical power to the motor 22 in response to signals received from the trigger switch 52 and the trigger direction switch 54. The transmission 26 can be any type of transmission that can be employed to provide a speed reduction and torque multiplication function. In the particular example provided, the transmission 26 is a three-stage, two-speed transmission. It will be appreciated, however, that the transmission 26 may include more or fewer stages, and may be configured to provide more or fewer speed ratios. If desired, a clutch assembly (not shown) or a suitable control algorithm can be configured to limit rotary power that is transmitted between the transmission 26 and the output spindle 30.

Additionally, the tool body 12 includes a light array 100, a shroud 102, and a light array switch 104. With additional reference to FIG. 3, the light array 100 can comprise one or more light sources 110 that can be mounted to a front end of the housing 20. In the particular example provided, the light array 100 comprises six light emitting diodes that are arranged concentrically about a rotational axis 116 of the output spindle 30. The shroud 102 can be configured to house the light array 100 and to cover an axial space (best shown in FIG. 3) between the light array 100 and the chuck 14. The light array switch 104 can be any type of switch for coupling the light array to the source of electric power. In the particular example provided, the light array switch 104 is a normally open momentary switch that permits the transmission of electrical energy (from the power source to the light array 100) when the light array switch 104 is activated (depressed) and inhibits the transmission of electrical energy when the light array switch 104 is deactivated (released). It will be appreciated that other types of switches, such as a toggle switch, may be employed in lieu of a momentary switch, and that other control elements, such as a timer, may be integrated in to the circuit that supplies electrical power to the light array 100.

Figure 3:
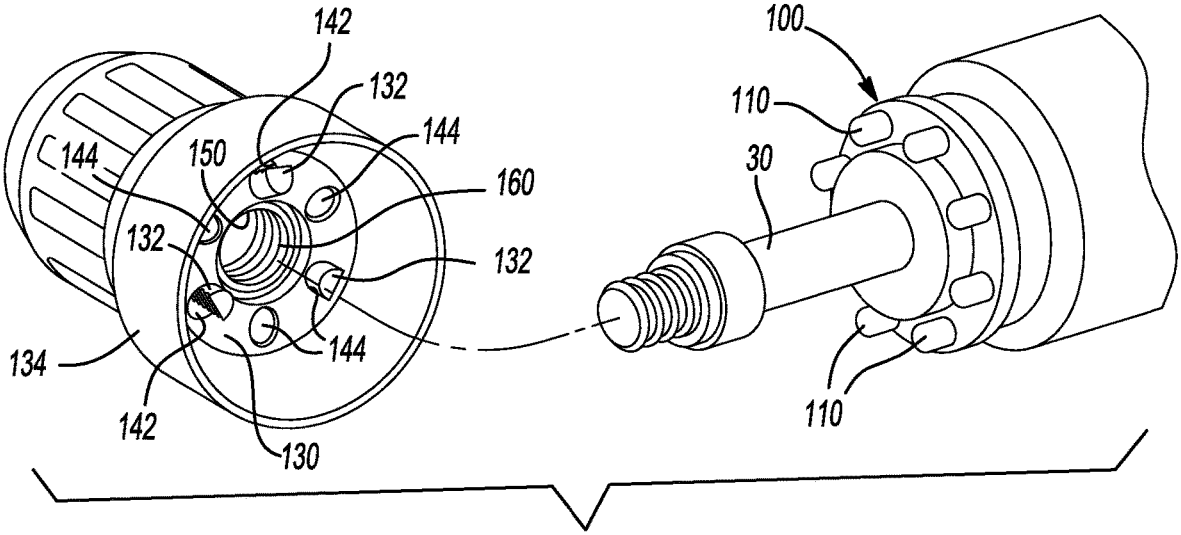
FIG. 3 is an exploded perspective view of a portion of the power tool of FIG. 1 with the shroud removed to better illustrate the light array and a light hole formed in a chuck body of a chuck.
Figure 4:
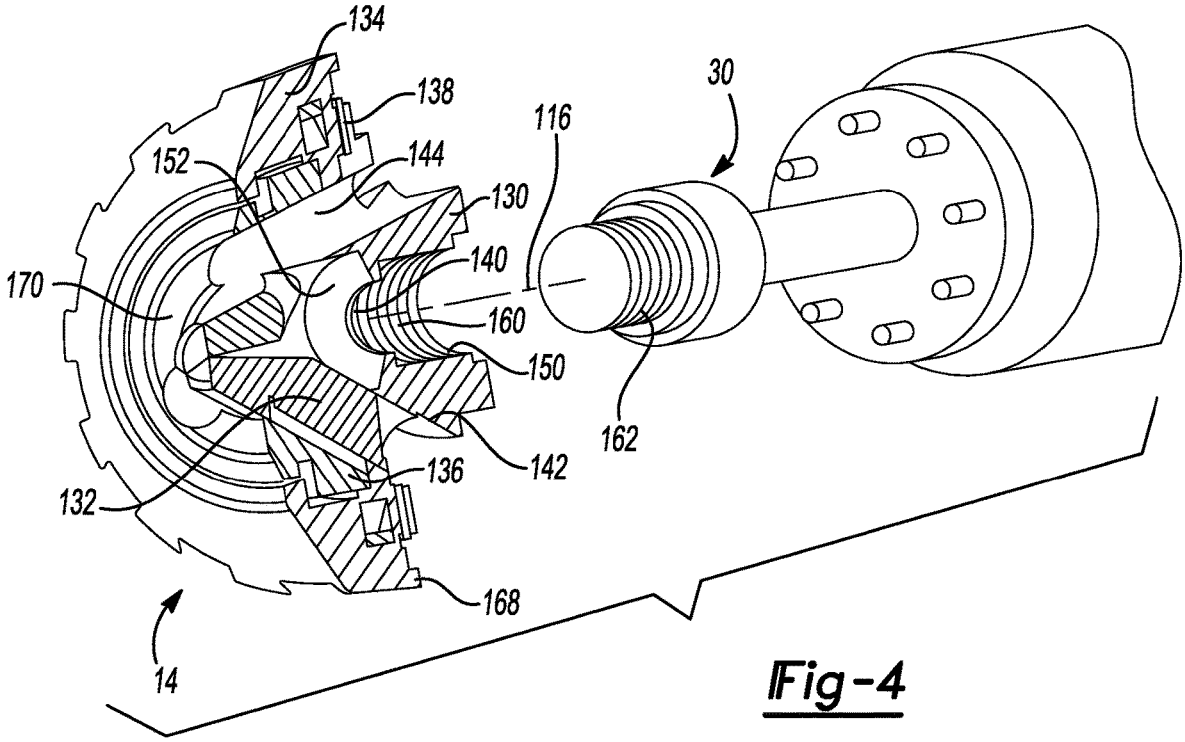
FIG. 4 is an exploded longitudinal section view of a portion of power tool of FIG. 1 illustrating the chuck and an output spindle.

With reference to FIGS. 3 and 4, the chuck 14 can be any type of chuck, such as a keyed or keyless chuck. In the particular example provided, the chuck 14 is a keyless chuck and includes a chuck body 130, a plurality of jaws 132, a sleeve member 134, a split nut 136, and a thrust bearing assembly 138. The chuck body 130 can be a generally cylindrical structure having a central cavity 140, a plurality of jaw apertures 142, and a plurality of light holes 144. The central cavity 140 can include a first cavity portion 150 and a second cavity portion 152. The first cavity portion 150 can include a female threaded portion 160 that can be sized to threadably engage mating threads 162 formed on the output spindle 30 of the tool body 12 (FIG. 1) such that a rear end 168 of the chuck body 130 and the output spindle 30 are coupled to one another for common rotation. The second cavity portion 152 can be configured to receive a bit (not shown) between the jaws 132. The jaw apertures 142 can be configured to receive the jaws 62. The jaw apertures 142 can be inclined relative to the rotational axis 116 and can extend through a front surface 170 of the chuck body 130. The light holes 144 can be inclined relative to the rotational axis 116 such that the light holes 144 approach the rotational axis 116 with increasing distance from the rear end 168 of the chuck 14. The light holes 144 can be formed through the front surface 170 of the chuck body 130 and can be configured to facilitate the transmission of light emanating from the light array 100 to a zone in front of the front surface 170 of the chuck body 130. It will be appreciated that the light array 100 can comprise a first quantity (N) of light sources 110 and that the chuck body 130 can have a second quantity (n) of light holes 144 and that the first quantity (N) and the second quantity (n) could be set in a desired manner. For example, the first quantity (N) could be set greater than the second quantity (n), or the first quantity (N) could be greater than or equal to twice the second quantity (n). In the particular example provided, the first quantity (N) is equal to six (i.e., there are six light sources 110 in the light array 100) and the second quantity (n) is equal to three (i.e., there are three light holes 144 in the chuck body 130). Each of the jaws 132 can be received in an associated one of the jaw apertures 142. The sleeve member 134 can be rotatably received over the chuck body 130 and the jaws 132. The split nut 136 can have a plurality of threads (not specifically shown) that are threadably engaged to threaded surfaces (not specifically shown) on the jaws 132. The split nut 136 can be coupled to the sleeve member 134 for common rotation and in the particular example provided, the split nut 136 is press-fit into the sleeve member 134. The thrust bearing assembly 138 can be received axially between the sleeve member 134 and the chuck body 130 (or a component that is fixedly coupled to the chuck body 130).

With reference to FIGS. 1, 2 and 4, when the power tool 10 is to be operated, a user may depress the light array switch 104 to illuminate the light array 100. Light emanating from the light source(s) 110 can be transmitted through the shroud 102 and against the rear end 168 of the chuck 14. It will be appreciated that some of the light generated by the light array 100 will be transmitted through the light holes 144 and upon exiting the chuck body 130, will illuminate a zone located in front of the chuck body 130. The light array 100 can remain in an activated (i.e., light generating) state until the light array switch 104 is released. Alternatively, the light array 100 can be deactivated upon the occurrence of one or more predetermined conditions (e.g., the lapsing of a predetermined time increment). Also alternatively, the light array 100 could be activated through operation of the trigger switch 52 (i.e., so that the light array 100 and the motor 22 are operated via a common switch).

In some situations it may be desirable to equip the power tool 10 with additional lighting capabilities. In the particular example provided, the tool body 12 includes a work light 200 that is located vertically between the trigger assembly 24 and the chuck 14. The work light 200 can be activated in any manner desired, such as a dedicated switch or via the trigger switch 52.

Figure 5:
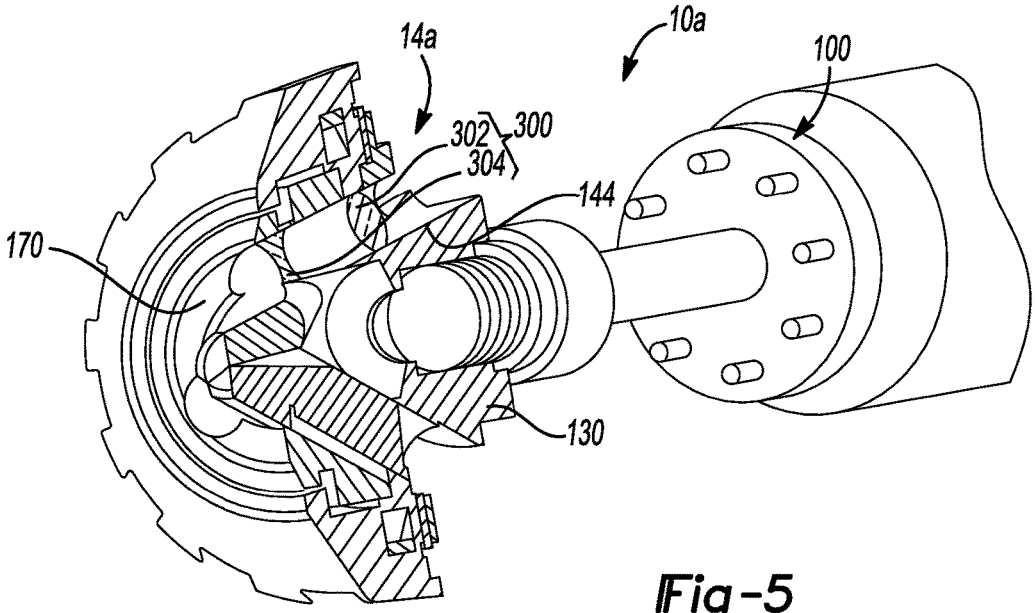
FIG. 5 is a longitudinal section view of a portion of a second power tool constructed in accordance with the teachings of the present disclosure.

With reference to FIG. 5, an additional example of a power tool constructed in accordance with the teachings of the present disclosure is indicated by reference numeral **10*a*. The power tool 10*a* is generally similar to the power tool 10 of FIG. 1, except that the chuck 14*a* further includes at least one optical element 300 received in each of the light holes 144. In the particular example provided, the at least one optical element 300 comprises a rear optical element 302 and a front optical element 304. Each of the rear optical elements 302 can be a lens that is configured to focus light that is directed from the light array 100 (FIG. 2) into a respective one of the light holes 144, while each of the front optical elements 304 can be a lens that is configured to spread light that is exiting a respective one of the light holes 144. The front optical elements 304 can be positioned axially within the light holes 144 rearwardly of the front surface 170 of the chuck body 130 so as to reduce the risk that the front optical elements 304 would be damaged if the front surface 170 rubs against another object when the power tool 10*a* is operated. It will be appreciated that it is not necessary to use both rear and front optical elements 302 and 304 (i.e., together) and that it may be desirable in some situations to use only rear optical elements 302 or only front optical elements 304. It will also be appreciated that while the front and rear optical elements 302 and 304 have been described and illustrated as being discrete components, the front and rear optical elements 302 and 304 could be formed on a monolithic optical element (e.g., on the opposite ends of a plastic cylinder). Moreover, it will be appreciated that the front and rear optical elements 302 and 304** could be any type of optical element (including an optical element with parallel planar surfaces.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A drill comprising:

a drill body having an output spindle and a motor for driving the output spindle; and a chuck coupled to the output spindle for rotation therewith;

wherein the chuck comprises a chuck body, a plurality of jaws and an outer sleeve;

wherein the chuck body includes a plurality of jaw apertures configured to receive the plurality of jaws;

wherein the chuck further comprises a split nut coupled to the outer sleeve;

wherein the jaw apertures are inclined with respect to an axis of rotation of the chuck;

further comprising at least one light source mounted on the tool body; and a plurality of holes formed through the chuck allowing light from the at least one light source to travel through the holes and illuminate a zone in front of the chuck.

2. The drill of claim 1, wherein the chuck further comprises a bearing assembly received axially between the sleeve member and the chuck body.

3. The drill of claim 1, wherein the at least one light source comprises at least five light sources.

4. The drill of claim 1, wherein there are at least twice as many light sources as holes.

5. The drill of claim 1, further comprising a first actuatable switch for activating the motor; and a second actuatable switch for activating the at least one light source.

6. The drill of claim 1, wherein the at least one light source is radially surrounded at least in an area directly forward of the at least one light source.

7. The drill of claim 1, further comprising a shroud;

wherein the shroud radially surrounds the at least one light source in an area directly forward of the at least one light source.

8. The drill of claim 1, further comprising a shroud which at least partially blocks light from the at least one light source.

9. The drill of claim 1, wherein the chuck includes a rear end at which the output spindle is received by the chuck;

wherein the chuck includes a front end opposite the rear end;

wherein the chuck includes a front surface at the front end, and wherein the plurality of jaws extend forward of the front surface.

10. A power tool comprising:

a tool body having an output spindle and a motor for driving the output spindle;

a chuck coupled to the output spindle for rotation therewith, the chuck comprising a chuck body, a sleeve member and a plurality of jaws;

a trigger assembly configured to activate the motor; and at least one light source mounted on the tool body;

wherein the chuck includes a plurality of holes formed through the chuck allowing light from the at least one light source to travel through the holes and illuminate a zone in front of the chuck;

wherein the at least one light source is radially surrounded at least in an area directly forward of the at least one light source so as to block light from the at least one light source from projecting radially outwardly.

11. The power tool of claim 10, wherein the chuck includes a rear end at which the output spindle is received by the chuck;

wherein the chuck includes a front end opposite the rear end;

wherein the chuck includes a front surface at the front end, and wherein the plurality of jaws extend forward of the front surface.

12. The power tool of claim 10, wherein the at least one light source is radially surrounded at least in an area directly forward of the at least one light source by a shroud.

13. The drill of claim 10, wherein the chuck further comprises a bearing assembly received axially between the sleeve member and the chuck body.

14. The drill of claim 10, wherein the at least one light source comprises at least five light sources.

15. The drill of claim 10, wherein there are at least twice as many light sources as holes.

16. The drill of claim 10, wherein the chuck further comprises a bearing assembly received axially between the sleeve member and the chuck body.

17. A method comprising:

providing a drill with a tool body and a chuck, the drill having a motor with a rotatable output spindle, the chuck comprising a chuck body, a plurality of jaws, an outer sleeve, and a bearing assembly received axially between the sleeve member and the chuck body, the chuck body including a plurality of jaw apertures configured to receive the plurality of jaws and the outer sleeve being configured to rotate relative to the jaws about a rotation axis of the chuck; and operating at least one light source on the tool body such that light emitted from the at least one light source is transmitted through at least one light hole formed through the chuck to illuminate a work zone, the chuck being disposed between the work zone and the tool body, the at least one light source remaining stationary relative to the chuck when the chuck is rotatably driven by the motor.

18. The method of claim 17, wherein the at least one light source is radially surrounded at least in an area directly forward of the at least one light source.

19. The method of claim 17, wherein there are at least twice as many light sources as holes.

20. The method of claim 17, wherein the chuck includes a rear end at which the output spindle is received by the chuck;

wherein the chuck includes a front end opposite the rear end;

wherein the chuck includes a front surface at the front end, and wherein the plurality of jaws extend forward of the front surface.

* * * * *